US008925144B2

(12) United States Patent
Mantell et al.

(10) Patent No.: US 8,925,144 B2
(45) Date of Patent: Jan. 6, 2015

(54) CANISTER VACUUM CLEANER

(71) Applicant: Dyson Technology Limited, Wiltshire (GB)

(72) Inventors: Howard Dennington Mantell, Bristol (GB); Giles Ashbee, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 14/106,322

(22) Filed: Dec. 13, 2013

(65) Prior Publication Data

US 2014/0165327 A1 Jun. 19, 2014

(30) Foreign Application Priority Data

Dec. 14, 2012 (GB) ..... 1222607.2

(51) Int. Cl.
*A47L 5/36* (2006.01)
*A47L 9/24* (2006.01)
*A47L 9/12* (2006.01)

(52) U.S. Cl.
CPC ..... *A47L 9/242* (2013.01); *A47L 5/362* (2013.01); *A47L 9/127* (2013.01)
USPC ..... 15/327.1; 15/414

(58) Field of Classification Search
USPC ..... 15/327.1, 414
IPC ..... A47L 5/36,9/24
See application file for complete search history.

(56) References Cited

FOREIGN PATENT DOCUMENTS

| | | |
|---|---|---|
| DE | 1 156 542 | 10/1963 |
| DE | 202 21 640 | 11/2006 |
| DE | 10 2010 039 282 | 2/2012 |
| GB | 2469044 | 10/2010 |
| GB | 2484120 | 4/2012 |
| GB | 2484146 | 4/2012 |
| GB | 2487398 | 7/2012 |

OTHER PUBLICATIONS

Search Report dated Apr. 12, 2013, directed to GB Application No. 1222607.2; 1 page.
International Search Report and Written Opinion mailed Feb. 10, 2014, directed to International Application No. PCT/GB2013/053086; 10 pages.

*Primary Examiner* — David Redding
(74) *Attorney, Agent, or Firm* — Morrison & Foerster LLP

(57) ABSTRACT

A canister vacuum cleaner comprising a main body, a hose, and a coupling for attaching the hose to the main body. The coupling includes a first part attached to the main body and a second part attached to the hose. Each part has a duct through which fluid is carried from the hose to the main body. The second part is attachable to the first part by sliding the second part relative to the first part along a sliding axis. When the second part is attached to the first part, the two ducts seal in a sealing plane that is non-orthogonal relative to the sliding axis.

20 Claims, 4 Drawing Sheets

CANISTER VACUUM CLEANER

REFERENCE TO RELATED APPLICATION

This application claims priority of United Kingdom Application No. 1222607.2 filed Dec. 14, 2012, the entire contents of which are incorporated herein by reference.

FIELD OF THE INVENTION

The present invention relates to a canister vacuum cleaner.

BACKGROUND OF THE INVENTION

FIG. 1 illustrates a canister vacuum cleaner 1 that comprises a main body 2 to which a hose 3 is removably attached by means of a coupling 4. The coupling 4 comprises a first part 5 attached to the main body 2 and a second part 6 attached to the hose 3. When storing the vacuum cleaner 1, a user may detach the hose 3 from the main body 2. Upon detaching the hose 3, the first part 5 of the coupling 4 extends outwardly from the main body 2 and impacts on the overall size of the main body 2. As a result, a larger storage space is required for the main body 2.

SUMMARY OF THE INVENTION

The present invention provides a canister vacuum cleaner comprising a main body, a hose, and a coupling for attaching the hose to the main body, wherein the coupling comprises a first part attached to the main body and a second part attached to the hose, each part comprises a duct through which fluid is carried from the hose to the main body, the second part is attachable to the first part by sliding the second part relative to the first part along a sliding axis, the duct of the second part seals against the duct of the first part when attached, and the two ducts seal in a sealing plane that is non-orthogonal relative to the sliding axis.

Since the sealing plane is non-orthogonal relative to the sliding axis, the first part of the coupling may be made smaller and thus a more compact main body may be achieved. In particular, should the coupling comprise a bend, part of the bend may be moved from the first part to the second part.

A seal may be provided between the two ducts in order to reduce leaks. In particular, the seal may be attached to an end of one of the ducts. The seal may be formed of a compressible material over which a layer of low friction material is provided. This then has the benefit that the other duct is better able to slide over and compress the seal as the two parts are brought together.

Owing to manufacturing tolerances, there is a variance in the position at which the second part of the vacuum cleaner of FIG. 1 locks to the first part. As a result, there is a variance in the separation between the two ducts. A relatively thick seal is therefore required in order to ensure that an airtight seal is formed over the full tolerance range. With the vacuum cleaner of the present invention, manufacturing tolerances may again result in a variance in the position of the second part when attached to the first part. However, since the sealing plane is non-orthogonal relative to the sliding axis, any variance in the position of the second part along the sliding axis does not translate into a corresponding variance in the separation of the two ducts. Instead, the variance in the separation of the two ducts is smaller. Consequently, a thinner seal may be employed between the two ducts.

For the avoidance of doubt, reference to the separation between the two ducts should be understood to mean in a direction normal to the sealing plane.

The sealing plane may be non-parallel relative to the sliding axis. As a result, the separation between the two ducts decreases as the second part slides relative to the first part. Accordingly, should a seal be located between the two ducts, the seal is increasingly compressed as the second part slides relative to the first part. As the second part slides relative to the first part, one of the ducts compresses and slides over the seal. As the duct slides over the seal, a resistance may be felt by the user. As the angle of the sealing plane relative to the sliding axis decreases, the distance over which the duct is required to slide over the seal increases. Accordingly, in order that the sliding distance is not excessive, the sealing plane may lie at an angle of no less than 3 degrees relative to the sliding axis.

As the angle of the sealing plane relative to the sliding axis increases, less of the bend in the coupling can be accommodated by the second part. Additionally, any variance in the position of the second part along the sliding axis translates to a greater variance in the separation of the two ducts. Accordingly, the sealing plane may lie at an angle of no more than 50 degrees relative to the sliding axis.

The sliding axis may be substantially parallel to a longitudinal axis of the hose. When attaching the hose to the main body, a user will typically hold the assembly at the hose. By ensuring that the second part slides in a direction parallel to the longitudinal axis of the hose, attachment of the hose to the main body is made easier for the user. In particular, a user is able to attach the hose to the main body using the same motion as that of the vacuum cleaner of FIG. 1.

The end of the duct of the first part (i.e. that end that seals against the duct of the second part) may be directed downwards. Accordingly, should a user detach the hose in order to store the vacuum cleaner, items are prevented from falling inadvertently into the duct of the first part.

The coupling may comprise a bend for turning the fluid. At least part of the bend then occurs within the duct of the second part. As a result, a more compact main body may be achieved.

The main body may comprise a dirt separator carried by a chassis, and the first part of the coupling may be attached to the chassis at a point beneath the dirt separator. This then has the benefit of improving the manoeuvrability of the vacuum cleaner. In particular, pulling the hose encourages the front end of the main body to lift off the cleaning surface. It is then generally easier to manoeuvre the main body to the left or right. Furthermore, by locating the first part of the coupling at a point beneath the dirt separator, a more compact vacuum cleaner may be realised.

The dirt separator may comprise an inlet opening in the base of the dirt separator, and the duct of the first part may seal against the inlet opening. By locating the inlet in the base of the dirt separator, a shorter and less tortuous path may be taken by the fluid carried to the dirt separator. As a result, the performance (e.g. airwatts) of the vacuum cleaner may be improved.

One of the parts may comprise runners and the other of the parts may comprise guide rails. The second part is then attachable to the first part by sliding the runners along the guide rails. Runners and guide rails provide convenient means for locating the two parts and for guiding the second part along the sliding axis.

The first part may comprise a seal located at an end of the duct of the first part. The seal has a ring portion and a tab portion that extends outwardly from the ring portion. As the second part slides relative to the first part, the duct of the second part may catch on the side of the seal. By providing a tab portion, it is more likely that the duct of the second part will contact the seal at a position behind the front edge of the tab portion. Consequently, the likelihood of the duct catching on the side of the seal is reduced.

As a user attempts to attach the hose to the main body, the second part of the coupling may be poorly controlled. It is therefore possible that the second part may catch the front of the tab portion. Accordingly, the first part may comprise a protective wall provided in front of the tab portion.

The present invention also provides a canister vacuum cleaner comprising a main body, a hose, and a coupling for attaching the hose to the main body, wherein the coupling comprises a first part attached to the main body and a second part attached to the hose, each part comprises a duct through which fluid is carried from the hose to the main body, the second part is attachable to the first part by sliding the second part relative to the first part along a sliding axis, the duct of the second part comprises a bend and seals against the duct of the first part when attached, and the two ducts seal in a sealing plane that is non-orthogonal relative to the sliding axis.

Since the sealing plane is non-orthogonal relative to the sliding axis, the first part of the coupling may be made smaller and thus a more compact main body may be achieved. In particular, at least part of the bend in the coupling is moved from the first part to the second part.

The sealing plane may be non-parallel relative to the sliding axis. As a result, the separation between the two ducts decreases as the second part slides relative to the first part. Accordingly, should a seal be located between the two ducts, the seal is increasingly compressed as the second part slides relative to the first part.

The end of the duct of the first part (i.e. that end that seals against the duct of the second part) may be directed downwards. Accordingly, should a user detach the hose in order to store the vacuum cleaner, items are prevented from falling inadvertently into the duct of the first part.

The main body may comprise a dirt separator carried by a chassis, and the first part of the coupling may be attached to the chassis at a point beneath the dirt separator. This then has the benefit of improving the manoeuvrability of the vacuum cleaner. In particular, pulling the hose encourages the front end of the main body to lift off the cleaning surface. It is then generally easier to manoeuvre the main body to the left or right. Furthermore, by locating the first part of the coupling at a point beneath the dirt separator, a more compact vacuum cleaner may be realised.

The dirt separator may comprise an inlet opening in the base of the dirt separator, and the duct of the first part may seal against the inlet opening. By locating the inlet in the base of the dirt separator, a shorter and less tortuous path may be taken by the fluid carried to the dirt separator. As a result, the performance (e.g. airwatts) of the vacuum cleaner may be improved.

One of the parts may comprise runners and the other of the parts may comprise guide rails. The second part is then attachable to the first part by sliding the runners along the guide rails. Runners and guide rails provide convenient means for locating the two parts and for guiding the second part along the sliding axis.

The present invention further provides a canister vacuum cleaner comprising a main body, a hose, and a coupling for attaching the hose to the main body, wherein the main body comprises a dirt separator carried by a chassis, the dirt separator comprises an inlet opening in a base of the dirt separator, the coupling comprises a first part attached to the chassis and a second part attached to the hose, each part comprises a duct through which fluid is carried from the hose to the dirt separator, the duct of the first part seals against the inlet opening, the second part is attachable to the first part by sliding the second part relative to the first part along a sliding axis, the duct of the second part seals against the duct of the first part when attached, and the two ducts seal in a sealing plane that is non-orthogonal relative to the sliding axis.

Again, since the sealing plane is non-orthogonal relative to the sliding axis, the first part of the coupling may be made smaller and thus a more compact main body may be achieved. Additionally, by locating the inlet in the base of the dirt separator, a shorter and less tortuous path may be taken by the fluid carried to the dirt separator. As a result, the performance (e.g. airwatts) of the vacuum cleaner may be improved.

BRIEF DESCRIPTION OF THE DRAWINGS

In order that the present invention may be more readily understood, an embodiment of the invention will now be described, by way of example, with reference to the accompanying drawings, in which.

DETAILED DESCRIPTION OF THE INVENTION

Figure 1:
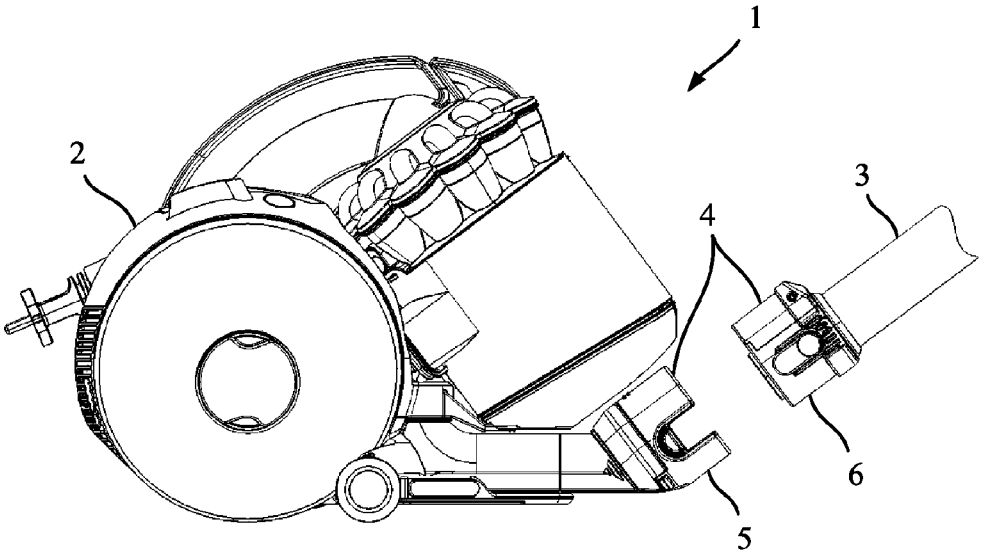
FIG. 1 is side view of a known type of vacuum cleaner.
Figure 2:
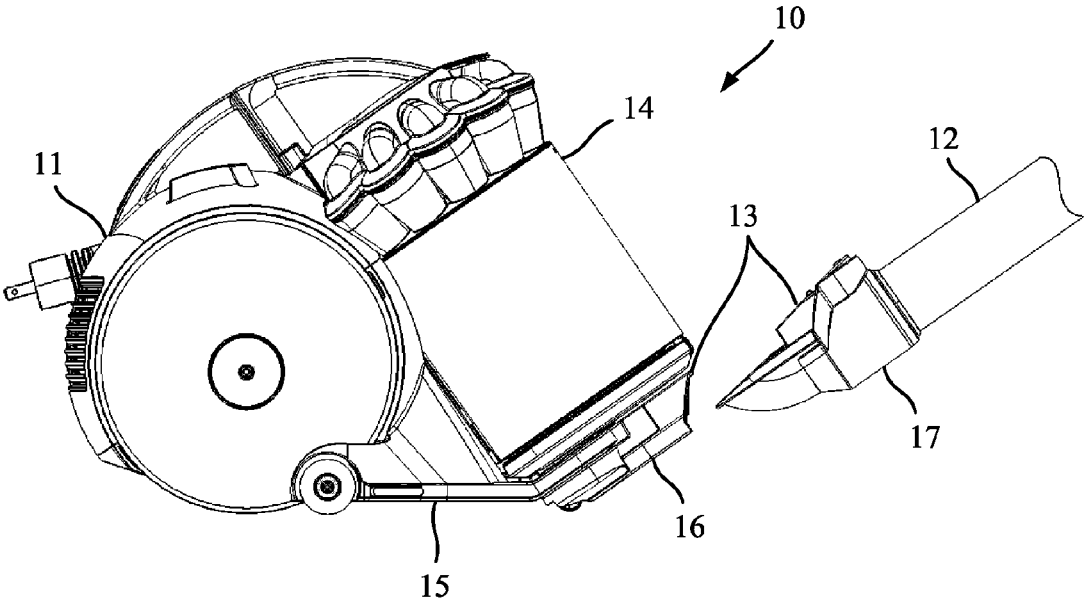
FIG. 2 is a side view of a vacuum cleaner in accordance with the present invention.
Figure 3:
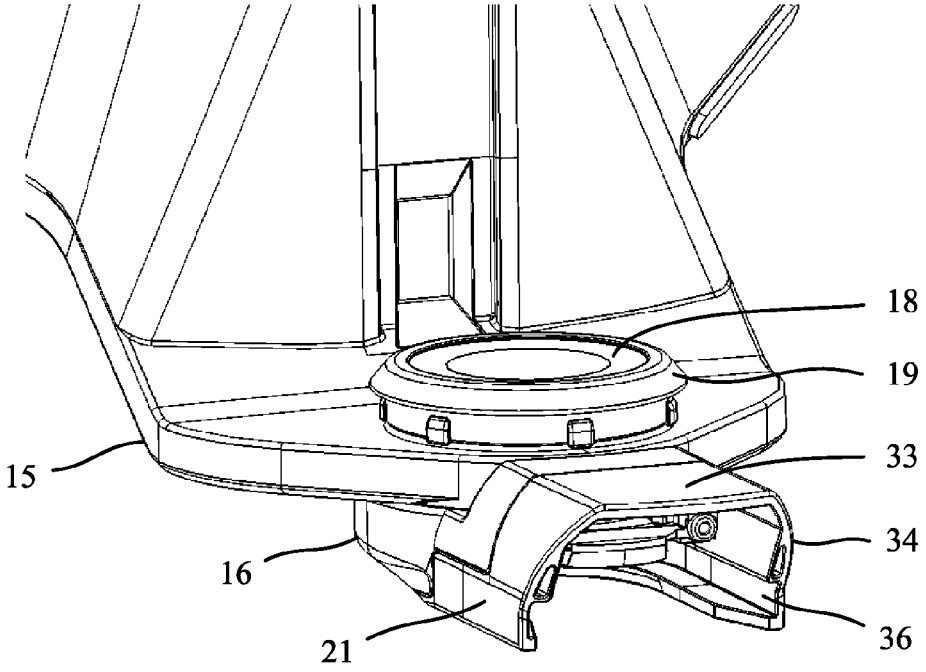
FIG. 3 is an orthographic view of a first part of the hose coupling of the vacuum cleaner of FIG. 2, wherein the dirt separator has been removed from the main body in order to better illustrate the hose coupling.
Figure 4:
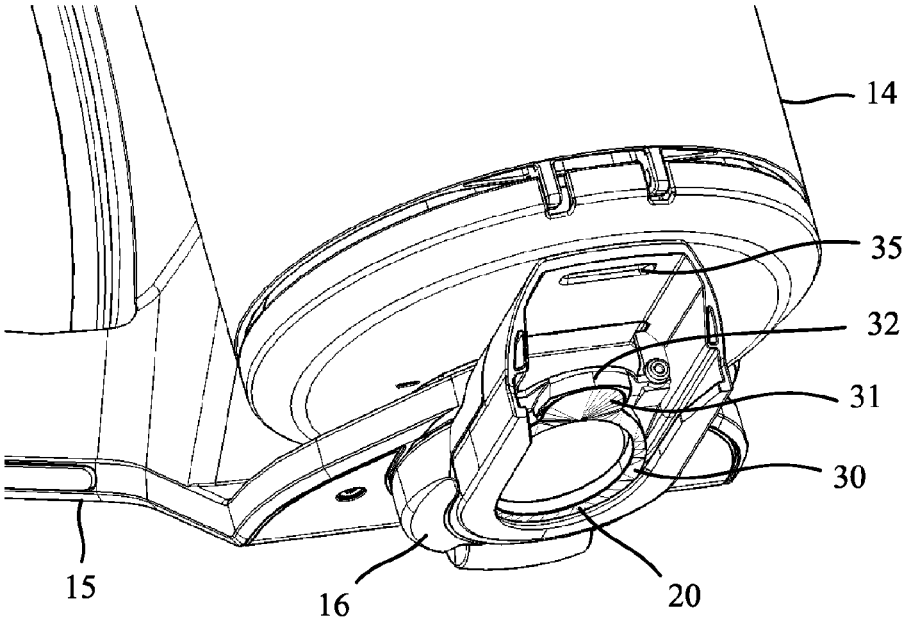
FIG. 4 is a further orthographic view of the first part of the hose coupling.
Figure 5:
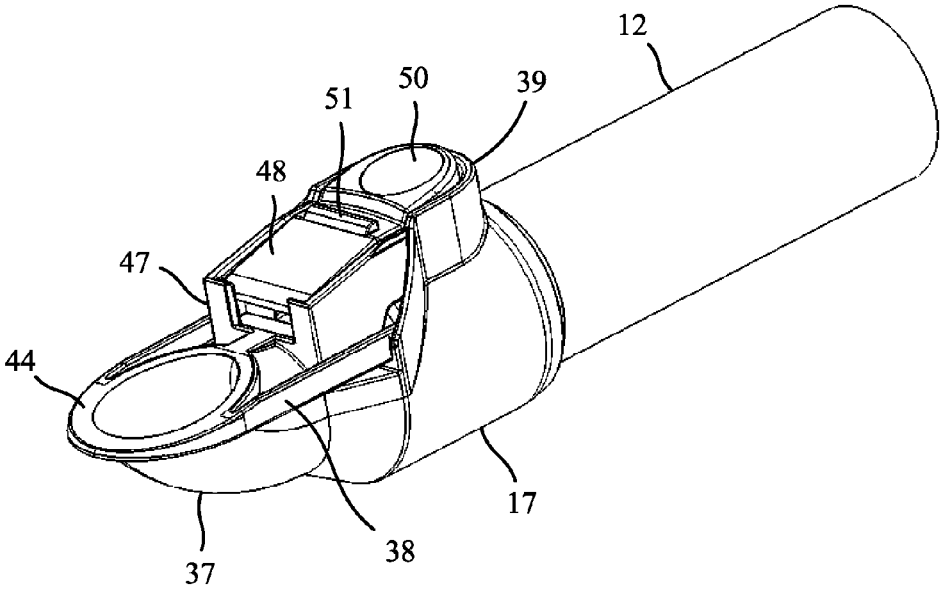
FIG. 5 is an orthographic view of a second part of the hose coupling of the vacuum cleaner of FIG. 2.

The vacuum cleaner 10 of FIGS. 2-7 is of a canister type and comprises a main body 11 to which a hose 12 is removably attached by means of a coupling 13.

The main body 11 comprises a dirt separator 14 carried by a chassis 15. The dirt separator 14 is removable from the chassis 15 in order that dirt separated by the dirt separator 14 may be emptied. For the purposes of clarity, the dirt separator 14 has been omitted from FIG. 3.

The coupling 13 comprises a first part 16 attached to the main body 11 and a second part 17 attached to the hose 12. More specifically, the first part 16 is attached to a front end of the chassis 15. The second part 17 is then removably attached to the first part 16.

The first part 16 comprises a first duct 18, a first seal 19, a second seal 20, and a support 21.

The first duct 18 comprises a first portion 22 fixed to and upstanding from the chassis 15, and a second portion 23 rotatable attached to the first portion 22. Rotatable attachment is achieved by means of a snap-ring 24 seated within annular grooves in the two portions 22,23. A gasket 25 is then provided between the two portions 22,23 in order to minimise leaks.

The first seal 19 surrounds a first end 26 of the first duct 18. When the dirt separator 14 is carried by the chassis 15, the first duct 18 projects into an inlet opening 28 in the base 29 of the dirt separator 14. The first seal 19 then seals against the base 29 of the dirt separator 14.

The second seal 20 is located at a second end 27 of the first duct 18 and comprises a ring portion 30 and a tab portion 31. The tab portion 31 extends outwardly from the ring portion 30. The end 27 of the first duct 18 comprises a protective wall 32 that surrounds the tab portion 31. The protective wall 32 is slightly taller than the front of the tab portion 31. The wall 32 then decreases in height from the front to the rear of the tab portion 31, i.e. in a direction towards the ring portion 30. The second seal 20 is formed of a compressible material (e.g. foam or rubber) over which a layer of low friction material (e.g. PTFE or HDPE) is provided.

The support 21 is attached to the first duct 18 and extends outwardly from the chassis 15. More specifically, the support 21 is attached to the second portion 23 and is thus free to rotate relative to the chassis 15. The support 21 comprises a top wall 33 and a pair of side walls 34. The inner surface of the top wall 33 includes a catch recess 35, and each of the side walls 34 comprises a channel or groove that defines a guide rail 36.

The second end 27 of the first duct 18 lies in a plane that is inclined relative to the axes of the guide rails 36. The angle of inclination is 8 degrees.

The second part 17 comprises a second duct 37, a pair of runners 38 and a catch assembly 39.

The second duct 37 is rotatably attached at one end to the hose 12. More specifically, the hose 12 comprises a cuff 40 to which the second duct 37 is rotatably attached. Rotatable attachment is achieved by means of a snap-ring 41 seated within grooves in the cuff 40 and the second duct 37, and a gasket 42 is provided between the cuff 40 and the second duct 37 to minimise leaks. The second duct 37 comprises a bend or elbow. Consequently the free end 44 of the second duct 37 lies in a different plane to that end attached to the hose 12.

The runners 38 take the form of two lateral projections that that extend along opposite sides of the second duct 37. The runners 38 extend along axes that are parallel to the longitudinal axis 46 of the hose 12.

The free end 44 of the second duct 37 lies in a plane that is inclined related to the axes of the runners 38. The angle of inclination is again 8 degrees.

The catch assembly 39 is located on an upper part of the second duct 37 and comprises a casing 47, a catch body 48 and a spring 49. The catch body 48 is pivotally attached at one end to the casing 47. The opposite end of the catch body 48 is shaped to form a button 50, and the catch body 48 comprises a locking projection 51 approximately midway between the two ends. The spring 49 is located between the underside of the button 50 and the casing 47 and biases the button 50 upwards.

The second part 17 is attachable to the first part 16 by inserting the runners 38 into the guide rails 36 and sliding the second part 17 relative to the first part 16. As the second part 17 slides relative to the first part 16, the second duct 37 slides over and compresses the second seal 20. The locking projection 51 of the catch assembly 39 then engages the catch recess 35 in the support 21 to lock the second part 17 to the first part 16. At this point the two ducts 18,37 are aligned and the second seal 20 is compressed between the two ducts 18,37 to form an airtight seal.

Figure 7:
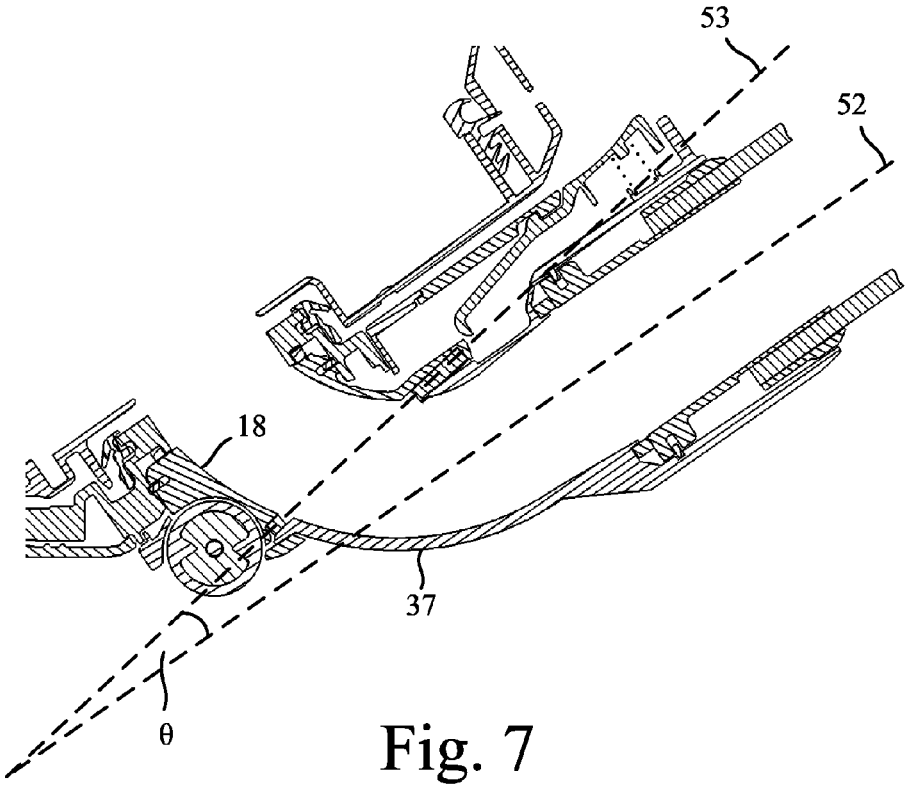
FIG. 7 is the same view as that of FIG. 6 in which the sliding axis and the sealing plane of the hose coupling, as well as the angle between the two, are highlighted.
Figure 6:
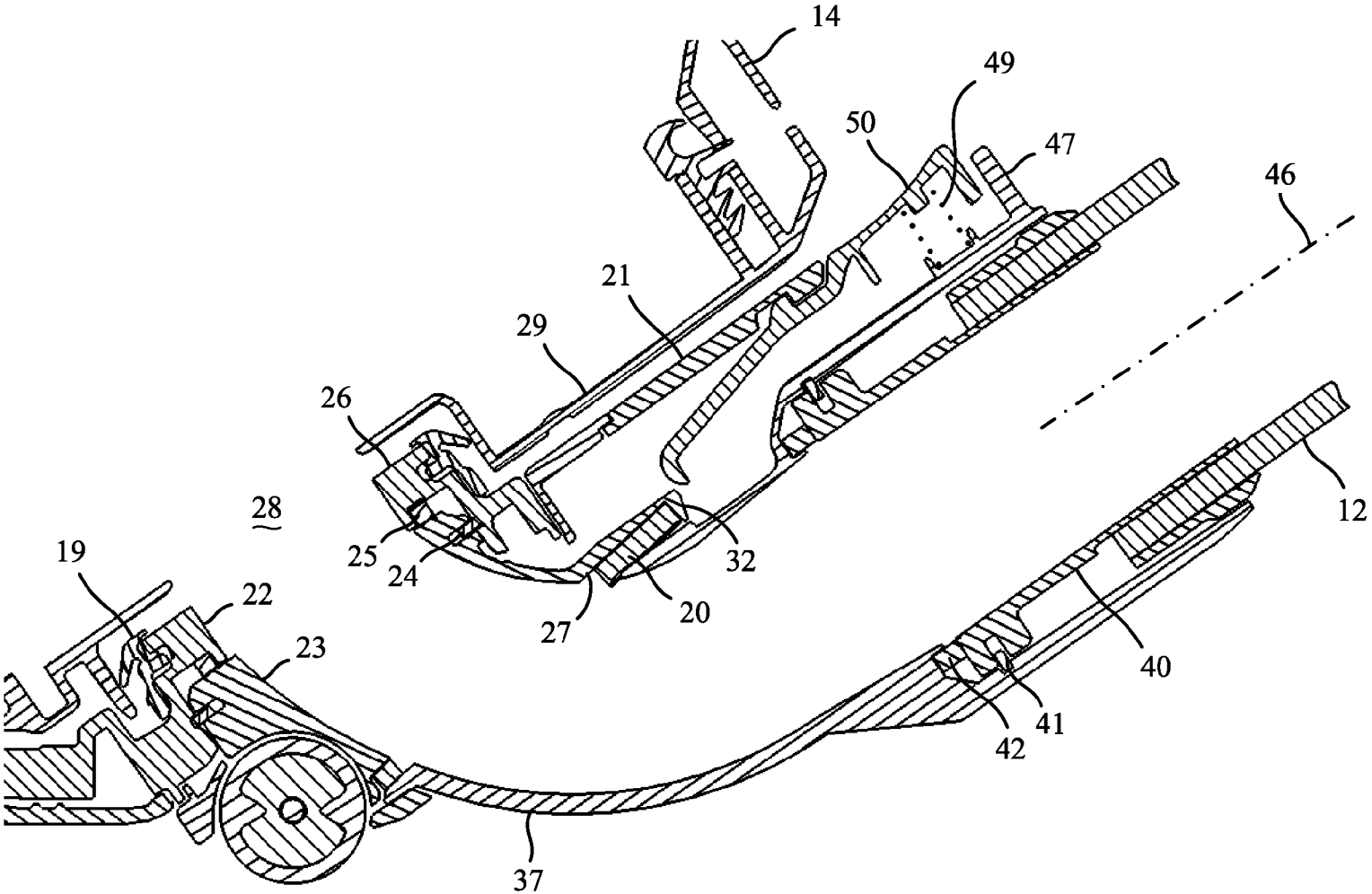
FIG. 6 is a side sectional view through the vacuum cleaner in the region of the hose coupling, wherein the hose is attached to the main body.

As illustrated in FIG. 7, the second part 17 may be said to slide relative to first part 16 along a sliding axis 52. The sliding axis 52 extends parallel to the axes of the guide rails 36 and runners 38. Furthermore, the ends 27,44 of the first and second ducts 18,37 may be said to seal in a sealing plane 53. As noted above, the ends 27,44 of the two ducts 18,37 are inclined relative to the axes of the guide rails 36 and runners 38 by an angle of 8 degrees. Consequently, the sealing plane 53 is inclined relative to the sliding axis 52 by an angle of 8 degrees.

As the second part 17 slides relative to the first part 16, the second duct 37 contacts, slides over and compresses the second seal 20. Owing to the relatively shallow angle at which the sealing plane 53 is inclined relative to the sliding axis 52, as well as the degree of play between the runners 38 and the guide rails 36, it is possible that, in the absence of the tab portion 31, the leading edge of the second duct 37 may catch the side of the ring portion 30 as the second part 17 slides relative to the first part 16. As a result, the seal 20 may be damaged or become detached from the first duct 18. By providing a tab portion 31, the second duct 37 contacts the seal 20 (be it the ring portion 30 or the tab portion 31) at a position behind the front edge of the tab portion 31. Consequently, in spite of the shallow angle of the sealing plane 53 and the play of the runners 38 within the guide rails 36, the second duct 37 is prevented from catching on the side of the seal 20.

As a user attempts to insert the runners 38 into the guide rails 36, the leading edge of the second duct 37 is often poorly controlled. Consequently, without the protective wall 32, the leading edge of the second duct 37 may catch the front of the tab portion 31. Again, this may damage the seal 20 or cause the seal 20 to detach from the first duct 16. By having a protective wall 32 located in front of the tab portion 31, damage to the seal 20 may be avoided.

The coupling 13 employed by the vacuum cleaner 10 of the present invention has several advantages over that illustrated in FIG. 1, as will now be described.

When storing the vacuum cleaner 1 of FIG. 1, a user may detach the hose 3 from the main body 2. Upon detaching the hose 3, the first part 5 of the coupling 4 extends outwardly from the main body 2 and impacts on the overall size of the main body 2. In particular, the first part 5 extends beyond the front of the main body 2 and thus increases the length of the main body 2. As a result, a larger storage space is required for the main body 2. With the vacuum cleaner 10 of the present invention, on the other hand, the first part 16 of the coupling 13 does not impact on the overall size of the main body 11. That is to say that the first part 16 does not increase the overall height, length or width of the main body 11. This is perhaps best demonstrated in FIG. 2. A more compact main body 11 arises because the bend in the coupling 13 has been moved (at least in part) from the first part 16 of the coupling 14 to the second part 17. This is made possible because the sealing plane 53 is inclined at a relatively shallow angle relative to the sliding axis 52.

When the hose 3 of the vacuum cleaner of FIG. 1 is detached from the main body 2, the first part 5 of the coupling 4 is directed upwards. Consequently, it is possible for items to fall inadvertently into the duct of the first part 5. With the vacuum cleaner 10 of the present invention, the duct 18 of the first part 16 of the coupling 4 is directed downwards. That is to say that the end 27 of the duct 18 that forms a seal with the second duct 37 is directed downwards when the vacuum cleaner 10 rests on a horizontal surface. As a result, it is not possible for items to fall into the duct 18.

When attaching the hose 3 of the vacuum cleaner 1 of FIG. 1 to the main body 2, the second part 6 may be said to slide relative to the first part 5. However, the ends of the ducts of the two parts 5,6 lie in planes that are orthogonal relative to the sliding axis; the end of the duct of the second part 6 can just be seen in FIG. 1. The two ducts therefore seal in a sealing plane that is orthogonal relative to the sliding axis. Let us say that, in the absence of any tolerances, the ends of the two ducts are separated by 2 mm at the point when the two parts 5,6 lock together. A seal of 3 mm thick is therefore employed in order to ensure that the seal is compressed between the two ducts to form an airtight seal. Owing to manufacturing tolerances, there is a variance in the position of the second part 6 along the sliding axis when the two parts 5,6 lock together. For example, the variance in the position of the second part 6 may be +/−1 mm. The sealing plane is orthogonal relative to the sliding axis. Consequently, any variance in the position of the second part 6 along the sliding axis translates directly to a corresponding variance in the separation between the two ducts. So in this particular example, the two ducts are separated by 2 mm+/−1 mm. It is therefore necessary to employ a seal that is 4 mm thick in order to ensure that at the largest separation (i.e. 3 mm) the seal continues to be compressed by around 1 mm. However, at the smallest separation (i.e. 1 mm), the seal is compressed from 4 mm to 1 mm. This represents a relatively large percentage reduction in the thickness of the seal. As a result, it may prove difficult or indeed impossible to compress the seal and lock the two parts 5,6 together. It may therefore be necessary to employ a larger seal and a larger nominal separation between the two ducts (e.g. a seal of 5 mm thick, and a separation of 3 mm+/−1 mm). The vacuum cleaner 1 of FIG. 1 therefore requires a relatively large seal in order to ensure that, at the tolerance limits, an airtight seal is achieved and a user can lock the two parts 5,6 of the coupling 4 together.

Consider now the vacuum cleaner 10 of the present invention. In order to draw a fair comparison with the example provided in the preceding paragraph, let us say that, in the absence of any tolerances, the ends 27,44 of the two ducts 18,37 are again separated by 2 mm at the point when the two parts 16,17 lock together. A seal 20 of 3 mm thick is therefore employed in order to ensure that the seal 20 is compressed between the two ducts 18,37. Let us further say that, owing to manufacturing tolerances, the amount by which the second part 17 slides relative to the first part 16 varies by +/−1 mm. Importantly, with the present invention, the sealing plane 53 is non-orthogonal relative to the sliding axis 52. Consequently, movement of the second part 17 along the sliding axis 52 does not translate to an equivalent change in the separation of the two ducts 18,37. When the second part 17 moves along the sliding axis 52 by an amount $\Delta d$, the separation between the two ducts 18,37 changes by an amount $\Delta d.\sin\theta$, where $\theta$ is the angle between the sealing plane 53 and the sliding axis 52. With the vacuum cleaner 1 of FIG. 1, the sealing plane is orthogonal (i.e. at 90 degrees) relative to the sliding axis. Consequently, when the second part slides by 1 mm along the sliding axis, the separation between the two ducts changes by 1 mm. With the present invention, on the other hand, the sealing plane 53 is inclined at 8 degrees relative to the sliding axis 52. Consequently, when the second part 17 slides by 1 mm along the sliding axis 52, the separation between the two ducts 18,37 (i.e. in a direction normal to the sealing plane 53) changes by just 0.14 mm. So although there is a variance in the position of the second part 17 along the sliding axis 52 of +/−1 mm, this translates into a variance in the separation of the two ducts 18,37 of just +/−0.14 mm. Accordingly, at the largest separation of the two ducts 18,37 (i.e. 2.14 mm) the seal 20 continues to be compressed by around 1 mm. Additionally, at the smallest separation (i.e. 1.86 mm), the seal 20 is compressed by an additional 0.14 mm, which represents a relatively small percentage change. Consequently, a user would have no difficulty in locking the two parts 16,17 together.

With the vacuum cleaner 1 of FIG. 1, a thicker seal and a larger nominal separation between the two ducts is required in order to ensure that an airtight seal is achieved over the full tolerance range without requiring any effort on the part of the user to lock the two parts together. In contrast, with the vacuum cleaner 10 of the present invention, the same result may be achieved with a thinner seal and a smaller nominal separation.

In the embodiment described above, the first part 16 of the coupling 13 is attached to a lower part of the main body 11. In particular, the first part 16 is attached to a front of the chassis 15 at a point beneath the dirt separator 14. This then has the benefit of improving the manoeuvrability of the vacuum cleaner 10. For example, by locating the first part 16 of the coupling 13 at the front of the chassis 15, the vacuum cleaner 10 may be manoeuvred forwards by pulling at the hose 12. Additionally, by locating the first part 16 of the coupling 13 at a lower part of the main body 11, pulling the hose 12 encourages the front end of the main body 11 to lift off the cleaning surface. There are therefore fewer points of contact between the chassis 15 and the cleaning surface. As a result, it is generally easier to turn the main body 11 to the left or right. Furthermore, by locating the first part 16 of the coupling 13 beneath the dirt separator 14, a more compact vacuum cleaner 10 may be realised. Nevertheless, in spite of the aforementioned advantages, the first part 16 of the coupling 13 could conceivably be attached to the main body 11 at other locations.

In the embodiment described above, the sealing plane 53 is inclined at an angle of 8 degrees relative to the sliding axis 52. It will, however, be appreciated that other angles of inclination may be employed. Indeed, the benefits described above are achieved to some extent so long as the sealing plane 53 is non-orthogonal relative to the sliding axis 52. However, as the angle of inclination increases, less of the bend in the coupling 13 can be moved to the second part 17. Additionally, the quantity $\Delta d.\ \sin\theta$ increases. Consequently, the benefits described above diminish with increasing angle. The angle of inclination is therefore preferably no more than 50 degrees.

If the sealing plane 53 were parallel to the sliding axis 52 (i.e. if the sealing plane 53 were inclined at 0 degrees relative to the sliding axis 52) then the separation between the two ducts 18,37 would remain the same as the second part 17 slides relative to the first part 16. In order to ensure that second seal 20 is compressed between the two ducts 18,37, it would be necessary to start with a separation smaller than the seal thickness. A difficulty with this arrangement is that, as the second part 17 slides relative to the first part 16, the leading edge of the second duct 37 will catch the side of the seal 20. This may then damage the seal 20 or cause the seal 20 to separate from the first duct 18. This particular problem may be resolved by having, for example, a seal 20 that varies in thickness. However, a seal of varying thickness has its own difficulties. Employing a sealing plane 53 that is non-parallel to the sliding axis 52 has the advantage that the seal 20 is increasingly compressed as the second part 17 slides relative to the first part 16. Accordingly, a seal of uniform thickness may be employed.

With the vacuum cleaner 1 of FIG. 1, the seal is compressed by sliding the second part 6 relative to the first part 5 over a relatively short distance. So, for example, in order to compress the seal by 1 mm, the second part 6 need only move by 1 mm along the sliding axis. Consequently, the resistance felt by the user occurs over a relatively short distance. With the coupling 13 of the present invention, on the other hand, the seal 20 is compressed over a longer distance. For example, in order to compress the seal 20 by 1 mm, the second part 17 must move by 7.19 mm along the sliding axis 52. Throughout this movement, the second duct 37 is in contact with the seal 20 and thus the resistance felt by the user occurs over a longer distance. As the angle of inclination decreases, the distance over which the second duct 37 is required to slide over the seal 20 increases. Indeed, the sliding distance varies as the cosecant of the angle of inclination. Accordingly, in order that the sliding distance is not excessive, the angle of inclination of the sealing plane 53 relative to the sliding axis 52 is preferably no less than 3 degrees.

In the above discussion, reference is made to an angle of inclination between the sealing plane 53 and the sliding axis 52. Uncertainty can arise when referring to an angle that is defined between a line and a plane. For the avoidance of doubt, the angle of inclination (θ) is the complementary angle to that defined between the direction vector ($\vec{r}$) of the sliding axis 52 and the normal vector ($\vec{n}$) of the sealing plane 53, i.e. $\theta = \arcsin\{|\vec{r}.\vec{n}|/|\vec{r}|.|\vec{n}|\}$.

Although a particular embodiment has thus far been described, various modifications may be made without departing from the scope of the invention. Indeed, possible modifications have already been discussed. However, it should be appreciated that other modifications beyond that described above are possible. For example, in the embodiment described above, the second seal 20 is provided at an end 27 of the first duct 18. However, the seal 20 might equally be provided at an end 44 of the second duct 37. Nevertheless, locating the seal 20 at the end 27 of the first duct 18 has the advantage that, when the hose 12 is detached from the main body 11, the seal 20 is better protected. As a further example, the guide rails 36 may be moved from the first part 16 to the second part 17 (e.g. the second part 17 may comprise a pair of grooves) and the runners 38 may be moved from the second part 17 to the first part 16 (e.g. the side walls 34 may include lateral projections). Furthermore, in the embodiment described above, the first duct 18 has a first portion 22 that is fixed to the chassis 15 and a second portion 23 that is rotatably attached to the first portion 22. As a result, the hose 12 is free to swivel left and right relative to the main body 11. However, the first duct 18 may equally comprise a single portion that is fixed to the chassis 15. Consequently, the hose 12 may be used to turn the main body 11 to the left and right.

The invention claimed is:

1. A canister vacuum cleaner comprising a main body, a hose, and a coupling for attaching the hose to the main body, wherein the coupling comprises a first part attached to the main body and a second part attached to the hose, each part comprises a duct through which fluid is carried from the hose to the main body, the second part is attachable to the first part by sliding the second part relative to the first part along a sliding axis, the duct of the second part seals against the duct of the first part when attached, and the two ducts seal in a sealing plane that is non-orthogonal relative to the sliding axis.

2. The vacuum cleaner of claim 1, wherein the sealing plane is non-parallel relative to the sliding axis.

3. The vacuum cleaner of claim 1, wherein the sealing plane lies at an angle of no less than 3 degrees relative to the sliding axis.

4. The vacuum cleaner of claim 1, wherein the sealing plane lies at an angle of no more than 50 degrees relative to the sliding axis.

5. The vacuum cleaner of claim 1, wherein the sliding axis is substantially parallel to a longitudinal axis of the hose.

6. The vacuum cleaner of claim 1, wherein an end of the duct of the first part is directed downwards.

7. The vacuum cleaner of claim 1, wherein the coupling comprises a bend and at least part of the bend occurs within the duct of the second part.

8. The vacuum cleaner of claim 1, wherein the main body comprises a dirt separator carried by a chassis, and the first part of the coupling is attached to the chassis at a point beneath the dirt separator.

9. The vacuum cleaner of claim 8, wherein the dirt separator comprises an inlet opening in the base of the dirt separator, and the duct of the first part seals against the inlet opening.

10. The vacuum cleaner of claim 1, wherein one of the parts comprises runners and the other of the parts comprises guide rails, and the second part is attachable to the first part by sliding the runners along the guide rails.

11. The vacuum cleaner of claim 1, wherein the first part comprises a seal located at an end of the duct, and the seal comprises a ring portion a tab portion that extends outwardly from the ring portion.

12. The vacuum cleaner of claim 11, wherein the first part comprises a protective wall provided in front of the tab portion.

13. A canister vacuum cleaner comprising a main body, a hose, and a coupling for attaching the hose to the main body, wherein the coupling comprises a first part attached to the main body and a second part attached to the hose, each part comprises a duct through which fluid is carried from the hose to the main body, the second part is attachable to the first part by sliding the second part relative to the first part along a sliding axis, the duct of the second part comprises a bend and seals against the duct of the first part when attached, and the two ducts seal in a sealing plane that is non-orthogonal relative to the sliding axis.

14. The vacuum cleaner of claim 13, wherein the sealing plane is non-parallel relative to the sliding axis.

15. The vacuum cleaner of claim 13, wherein an end of the duct of the first part is directed downwards.

16. The vacuum cleaner of claim 13, wherein the main body comprises a dirt separator carried by a chassis, and the first part of the coupling is attached to the chassis at a point beneath the dirt separator.

17. The vacuum cleaner of claim 16, wherein the dirt separator comprises an inlet opening in the base of the dirt separator, and the duct of the first part seals against the inlet opening.

18. The vacuum cleaner of claim 13, wherein one of the parts comprises runners and the other of the parts comprises guide rails, and the second part is attachable to the first part by sliding the runners along the guide rails.

19. A canister vacuum cleaner comprising a main body, a hose, and a coupling for attaching the hose to the main body, wherein the main body comprises a dirt separator carried by a chassis, the dirt separator comprises an inlet opening in a base of the dirt separator, the coupling comprises a first part attached to the chassis and a second part attached to the hose, each part comprises a duct through which fluid is carried from the hose to the dirt separator, the duct of the first part seals against the inlet opening, the second part is attachable to the first part by sliding the second part relative to the first part along a sliding axis, the duct of the second part seals against the duct of the first part when attached, and the two ducts seal in a sealing plane that is non-orthogonal relative to the sliding axis.

20. The vacuum cleaner of claim 19, wherein the coupling comprises a bend and at least part of the bend occurs within the duct of the second part.

* * * * *